US006637096B2

(12) United States Patent
Kang

(10) Patent No.: US 6,637,096 B2
(45) Date of Patent: Oct. 28, 2003

(54) PROCESS FOR FORMING STRIKER FOR GLOVE BOX

(76) Inventor: Jin Hee Kang, 401 Munsung Villa, 465-7 Shinwal Dong, Yangcheon Ku, Seoul (KR)

( * ) Notice: Subject to any disclaimer, the term of this patent is extended or adjusted under 35 U.S.C. 154(b) by 0 days.

(21) Appl. No.: 09/986,833

(22) Filed: Nov. 13, 2001

(65) Prior Publication Data

US 2003/0090114 A1 May 15, 2003

(51) Int. Cl.[7] ..... B21B 1/46; B21P 17/00; B21D 53/46

(52) U.S. Cl. ..... 29/527.2; 29/527.1; 29/557; 29/3; 29/11; 29/412; 29/417

(58) Field of Search ..... 29/527.2, 527.1, 29/557, 3, 4, 11, 412, 417

(56) References Cited

U.S. PATENT DOCUMENTS 4,189,523 A * 2/1980 Pearson ..... 428/571
4,783,103 A * 11/1988 Schlegel ..... 292/216

* cited by examiner

*Primary Examiner*—John C. Hong
(74) *Attorney, Agent, or Firm*—GWiPS

(57) ABSTRACT

A novel striker for locking a glove box comprises a bracket (11) having at least two fastener holes (13), a bracket (11) being attached to an interior wall of crash pad or dashboard by fasteners through fastener holes (13) and a U-shaped latching loop (15, 25) being formed integrally with the bracket (11). The glove box is located in front of a passenger seat and hinged at the crash pad or dashboard for storing the miscellaneous in a vehicle. The U-shaped latching loop (15, 25) is upwardly bent with a predetermined angle against the bracket (11). A noise damping material (19) is coated on the latching loop (15, 25) by ejecting synthetic resins. A process for forming a striker of glove box comprises; setting process for setting a prepared sheet metal (S1-1), punching process (S1-2*a*) for punching fastener holes (13), first notching process (S1-2*b*), second notching process (S1-3), trimming process (S1-4) including either one of rounding process (S1-4A) or forging process (S1-4B) and restriking process (S1-4C) or curling process (S1-4D) and restriking process (S1-4E), bending process (S1-5), third notching process (S1-6), painting process (S1-7) and finally, finishing process (S-2) for coating a noise damping material (19).

7 Claims, 11 Drawing Sheets

PROCESS FOR FORMING STRIKER FOR GLOVE BOX

BACKGROUND OF THE INVENTION

1. Field of the Invention

The present invention relates to a striker for locking a glove box and process for forming the same. More particularly, the novel striker, which engages with a latching device to lock the glove box being located in front of a passenger seat for storing the miscellaneous in a vehicle, is integrally formed with a latching loop and bracket and a manufacturing process of the same.

2. Description of the Related Art

Today, a vehicle has become an integral part of daily life. Moreover, the vehicle becomes not only an unlimited transportation means, but also an accepted means of additional independent living space. In this point of view, providing many devices that comforts the passengers is as important as providing technology related to safety and smoothness of ridings.

The convenient devices provided in a vehicle are the cigarette lighter for lighting cigarette, ash tray, cup holder for holding drinks or cups, console box or glove box for storing miscellaneous being needed to the driver or passenger such as a flash light, gloves, cassette tapes, insurance card, vehicle registration or road maps. There are more convenient devices available for installation depending on the driver's interest and hobby.

Among these convenient devices, a typical one is the glove box being provided in front of a passenger seat for storing the miscellaneous. The glove box door is hinged and attached to an interior wall of crash pad or dashboard, and the door is lockable by the striker and latching devise.

As depicted in FIGS. 7*a* and 7*b*, a conventional striker (100) comprises a bracket (101) being attached to the interior wall of crash pad or dashboard, a latching loop (102) being fixed to the bracket (101) for locking the glove box. The latching loop (102) is welded to six protruding parts (101*a*) being formed on the bracket (101).

However, a manufacturing process of conventional striker requires a blanking process for punching out a prototype bracket from a metal plate, a bending process for bending the flanges of bracket. Simultaneously, a latching loop is provided through a separate process as follows: a cutting process is performed for cutting a rod in a predetermined length. A bending process is performed for forming the loop shape. Finally, a welding process combines the bracket and latching loop together. The conventional manufacturing process is relatively complicated due to separated manufacturing process and welding process for the bracket and latching loop.

Therefore, the conventional manufacturing process has disadvantages that: because of the separated manufacturing process and welding process, it requires relatively many production facilities and manpower. Specially, it is very hard to accurately control the final dimension of strikers during a welding process. Consequently, there are many default produced in the final strikers, which do not have acceptable tolerance of dimensions. Due to the inconsistent dimensions, the default strikers are mismatched with other related parts in the assembly line. It costly requires more labors to correct mismatching problems. Therefore, the production cost would be highly increased.

SUMMARY OF THE INVENTION

An improved striker for locking a glove box of the present invention is designed to overcome the disadvantages mentioned in the previous paragraph by considering the conventional problems.

An object of the present invention is to provide a glove box striker that a latching loop is integrally formed with a bracket by using a series automatic pressing or punching process and the process for forming the same.

To achieve the forgoing object, an improved striker for locking a glove box comprises a bracket having at least two fastener holes, which is attached on the interior wall of crash pad or dashboard by installing fasteners through fastener holes, a U-shaped latching loop formed integrally with the bracket and forwardly bent-up with a predetermined angle against the bracket and a noise damping materials being coated on the latching loop by ejecting synthetic resins.

According to the present invention, it is preferred to form an annular section of latching loop for a hollow center by rounding up process.

Further, to achieve the above object of the present invention, a process for forming a striker of glove box comprises: setting process for setting a basic sheet metal having a certain thickness, width and length of rectangular shape on a processing machinery; first notching process for punching out fastener holes with a certain preset diameter and removing a first portion (area) of inner loop to provide a latching space by punching out the basic sheet metal; second notching process for removing a second part (area) of outer loop substantially to form a prototype U-shaped latching loop by punching out the basic sheet metal; trimming process for rounding the edges of prototype latching loop; bending process for bending the latching loop upward with a predetermined angle against a bracket; third notching process for removing a third part of multi-bracket supporting area to separate an individual bracket by punching out the basic sheet metal; and finishing process for coating noise damping materials on the entire or partial area of latching loop by ejecting synthetic resins.

According to the present invention, it is preferred to round the rough cutting edges of prototype latching loop.

Alternatively, it is preferred to forge the rough cutting edges of prototype latching loop to form an octagonal section.

According to the present invention, it is preferred to include a restriking process for obtaining a final shape of latching loop to have the acceptable dimensions within a tolerance subsequent to the rounding process or forging process.

According to the present invention, it is preferred to include a curling process for rounding up the prototype latching loop to form an annular section.

According to the present invention, it is preferred to include a restriking process for obtaining an annular section of latching loop having acceptable dimensions within a tolerance subsequent to the curling process.

Accordingly, a manufacturing process of striker being integrally formed with the latching loop and bracket is simpler than that of conventional striker. Therefore, the navel striker has not only compatibility by reducing production cost, but also reliability by improving the noise damping for the locking device.

DETAILED DESCRIPTION OF THE PREFERRED EMBODIMENTS

An improved striker being integrally formed with a bracket and latching loop is disclosed in detail accompanying with the drawings.

Figure 1:
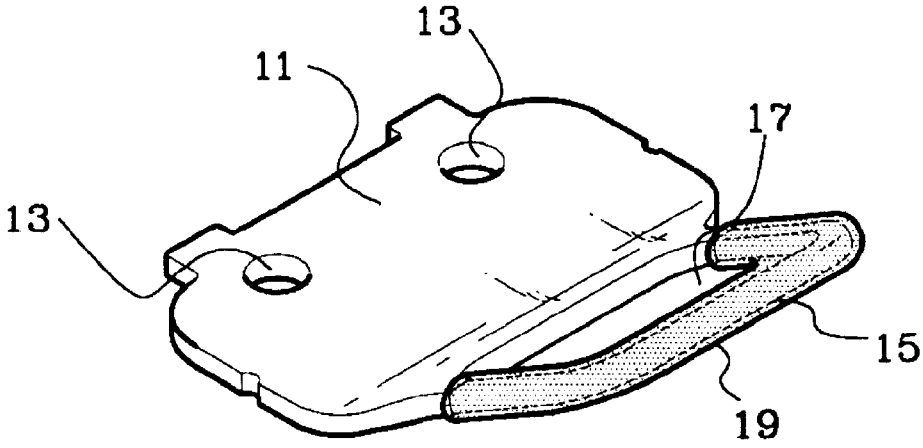
FIG. 1 is a perspective view of a striker for locking a glove box according to the present invention.

As depicted in FIG. 1, a striker for locking a glove box of the present invention comprises a bracket (11) having at least two fastener holes (13), a U-shaped latching loop (15) being integrally formed with the bracket (11) and forwardly bent-up with a predetermined angle against the bracket (11) and a noise damping materials (19) coated on the latching loop (15).

Generally, the bracket (11) is attached to an interior wall of crash pad or dashboard being located in front of a passenger seat by a couple of fasteners. There are at least two fastener holes on a bracket (11) for installing the fasteners. The glove box door is rotatively hinged at the crash pad or dashboard. There is also a latching device provided on the glove box door for locking or unlocking the glove box.

According to the present invention, a U-shaped latching loop (15) is integrally formed with and extended from the bracket (11). An inner area (17) of latching loop (15) is provided for latching or unlatching the latching device of glove box door. The latching loop (15) has an annular section with a hollow center. Moreover, it is not limited to apply the various sections of latching loop (15), such as a solid circular shape or round shape, annular shape, hexagonal shape or octagonal shape, etc.

The noise damping materials (19) made of synthetic resins or synthetic rubber such as a thermoplastic resin is coated on the entire or partial area of latching loop (15) by ejection means. Due to an application of noise damping materials (19), there is no noise generated from the locking device of glove box being latched with this novel striker, even if there are severe turbulences encountered during the vehicle operation.

Figure 2:
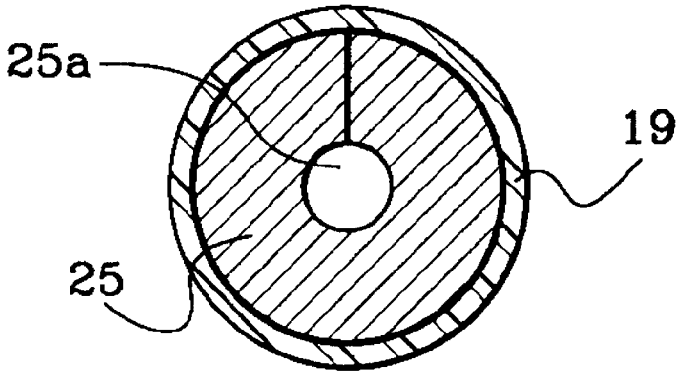
FIG. 2 is a sectional view of latching loop having an annular section according to the present invention.

As depicted in FIG. 2, an annular (25*a*) section of another embodiment of latching loop (25) is formed by a curling process and punching process. Further, the exterior latching loop (25) is coated with the noise damping materials (19) by ejection process.

Hereinafter, the process for forming a striker of glove box of the present invention is explained in detail.

Figure 3:
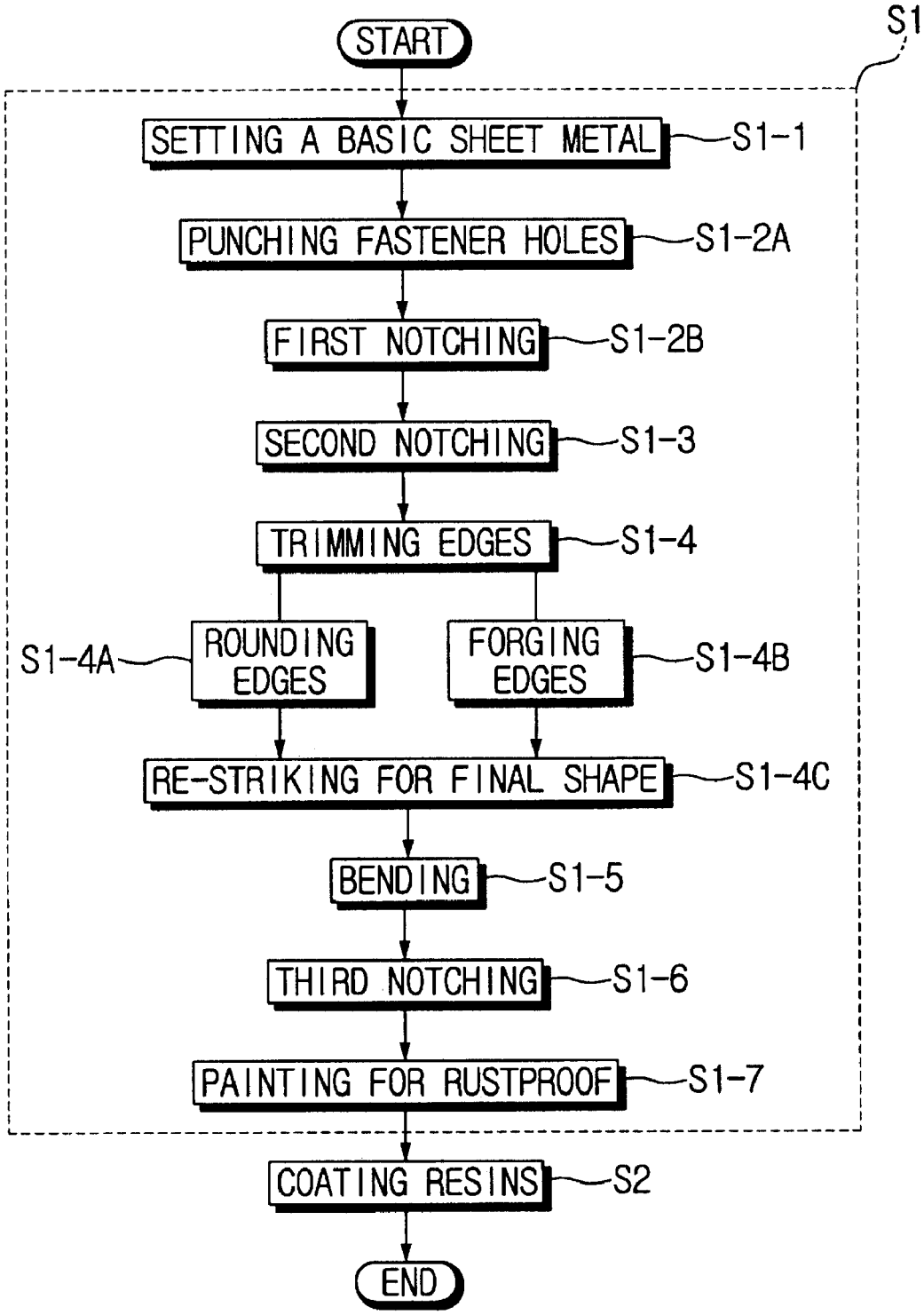
FIG. 3 is a flow chart for forming a striker of glove box according to the present invention.

As shown in FIG. 3, a flow chart for forming a striker of glove box is disclosed the steps: setting process (S1-1) is for setting a prepared basic sheet metal on a processing machinery. Punching process (S1-2*a*) is for punching out a couple of fastener holes (13) having certain preset diameter on the basic sheet metal. First notching process (S1-2*b*) is for punching out a first part (31) or area of inner loop to form a latching space. Second notching process (S1-3) is for punching out a second part (32) or area of outer loop to form a prototype latching loop. Trimming process (S1-4) is for trimming the rough cut edges of prototype latching loop. In addition to the trimming process (S1-4), it is preferred to include either one of rounding process (S1-4A) for rounding the rough cut edges of latching loop to form a circular section or forging process (S1-4B) for forging the rough cut edges of latching loop to form an octagonal section. Restriking process (S1-4C) is for obtaining the final shape of latching loop having allowable dimensions within a tolerance. Bending process (S1-5) is for bending the latching loop upwardly in a predetermined angle against the bracket (11). Third notching process (S1-6) is for punching out a third part or supporting area of multi-brackets of sheet metal to separate individual bracket. Painting process (S1-7) is for coating rustproof materials on the individual bracket. Finally, finishing process (S2) is for coating noise damping materials on the entire or partial latching loop by ejecting synthetic resins.

From FIG. 4*a* through FIG. 41, each step of series process for forming a striker of glove box is disclosed in a great detail.

Figure 4A:
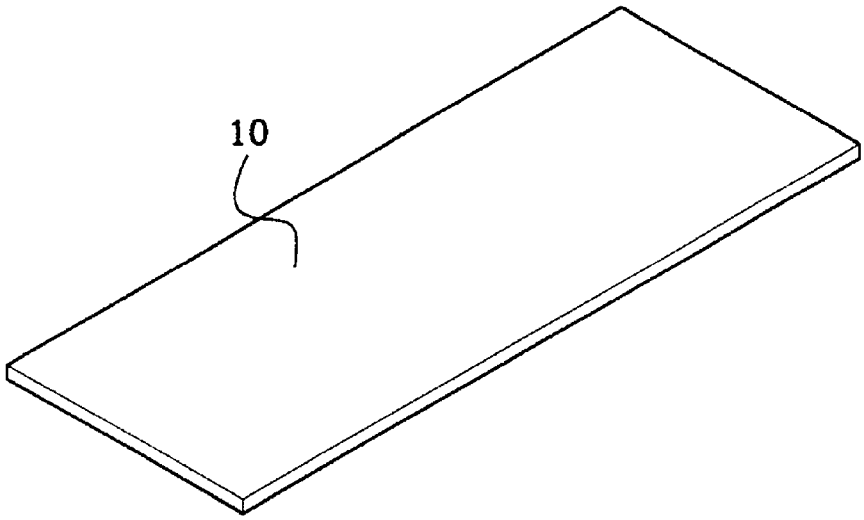
FIG. 4*a* is a prototype or basic sheet metal having a rectangular shape with required dimensions of thickness, width and length.
Figure 4B:
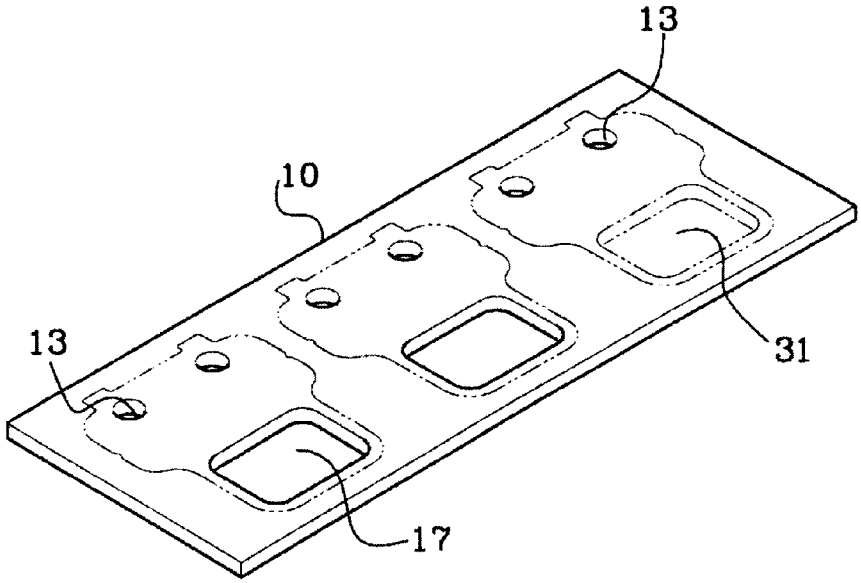
FIG. 4*b* shows a performance of punching process (S1-2*a*) for punching out fastener holes and first notching process (S1-2*b*).

First, as depicted in FIG. 4*a*, a prototype or basic sheet metal (10) having a rectangular shape with required dimensions such as a thickness, width and length is selectively provided. As depicted in FIG. 4*b*, a series of multi-latching loop drawing is marked on the provided basic sheet metal (10). In a step of S1-1, the prepared basic sheet metal (10) is set on the progressive processing machinery for performing a series process. In a step of S1-2*a*, punching process is properly punched out a series of fastener holes (13) having certain preset diameter at the precise locations of basic sheet metal (10) along the lengthwise direction. In a step of S1-2*b*, first notching process is performed for punching out a first part (31) or an area of inner loop to form a latching space (17).

Figure 4C:
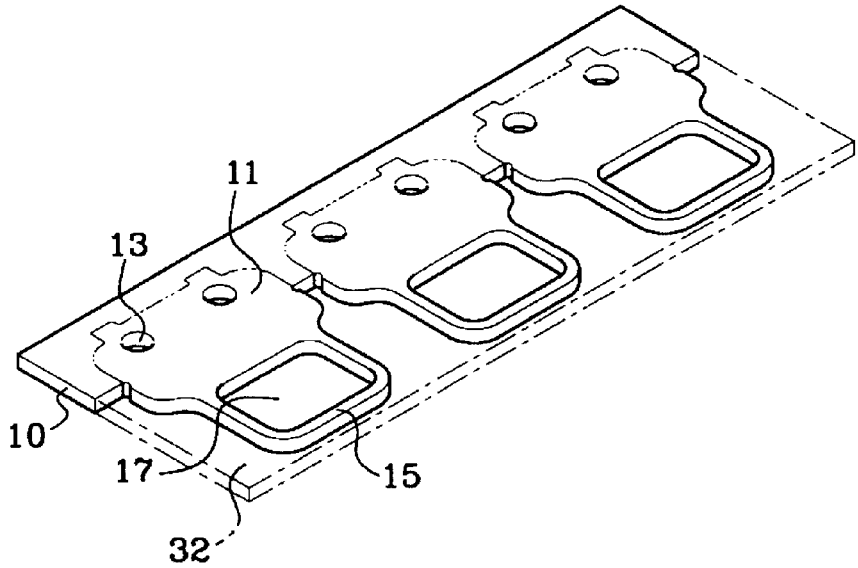
FIG. 4*c* shows a performance of second notching process (S1-3) for punching out a second part.

As depicted in FIG. 4*c*, second notching process (S1-3) is performed for punching out a second part (32) or an area of outer loop of basic sheet metal to form a prototype latching loop (15). The prototype latching loop (15) has a rectangular or loop shape being integrally extended from a bracket (11). The cross section of prototype latching loop (15) has a sharp square edges or corners due to a rough cutting process.

Figure 4D:
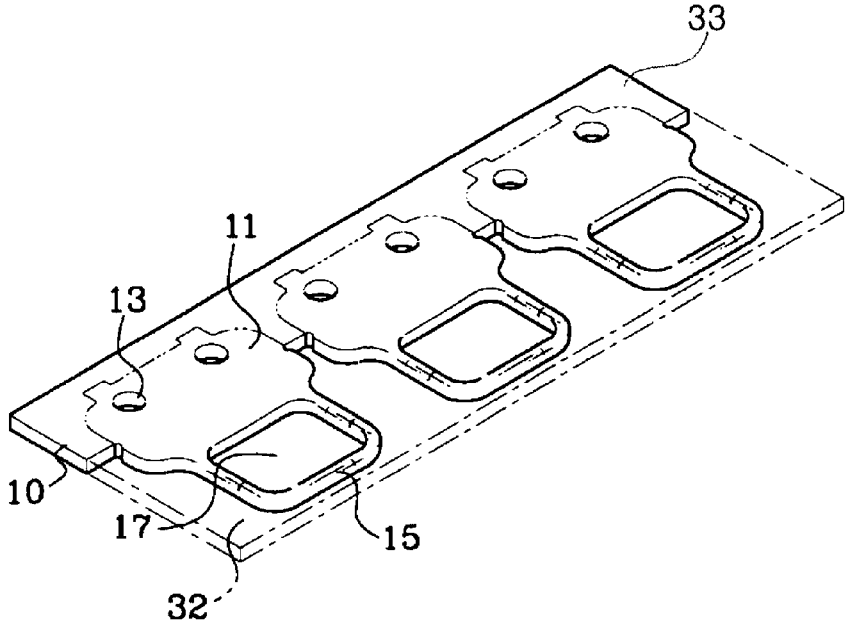
FIG. 4*d* show a performance of trimming process (S1-4) for rounding the sharp edges of rough cutting prototype latching loop.

Next step as depicted in FIG. 4*d* is a trimming process (S1-4) for trimming the rough cut edges or corners of prototype latching loop (15). The trimming process (S1-4) includes either one of rounding process (S1-4A) for rounding the rough cut edges or corners of latching loop (15) or forging process (S1-4B) for forging the rough cut edges or corners of latching loop (15) to form a circular section or octagonal section.

Figure 4E:
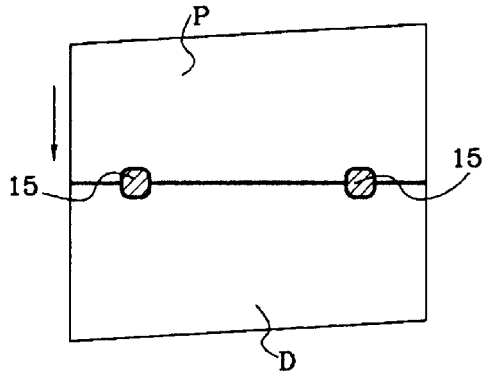
FIGS. 4*e* to 4*h* illustrate the various rounding process with several sets of dies and punches for trimming the sharp edges of rough cutting prototype latching loop to form either one of circular, hexagonal or octagonal sections.

As shown in FIG. 4*e*, the prototype latching loop (15) is placed in a set of die (D) and punch (P) having semicircular grooves for trimming the rough cut edges by pressing down the punch (P) so that the sharp edges of prototype latching loop (15) are rounded to form a circular or octagonal cross section.

Figure 4F:
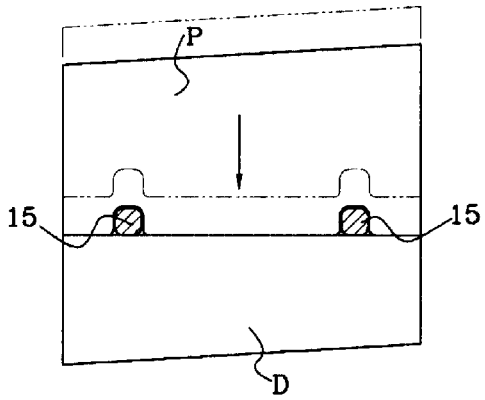
Figure 4G:
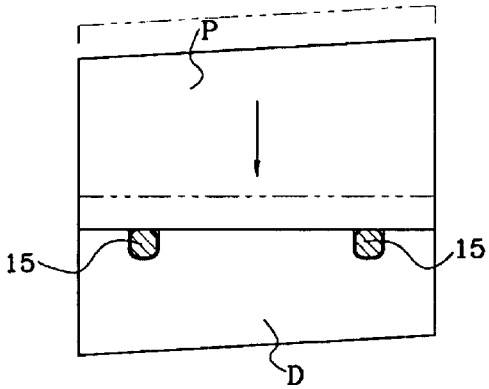

An alternative rounding process illustrates that the prototype latching loop (15) is placed on a flat surface die (D) and pressing down the punch (P) having a circular groove for trimming the top edges of prototype latching loop (15) as shown in FIG. 4*f*. Then, the half trimmed prototype latching loop is placed in a die (D) having a circular groove and pressing down a flat surface punch (P) for trimming the bottom edges of prototype latching loop (15) as shown in FIG. 4*g*.

Figure 4H:
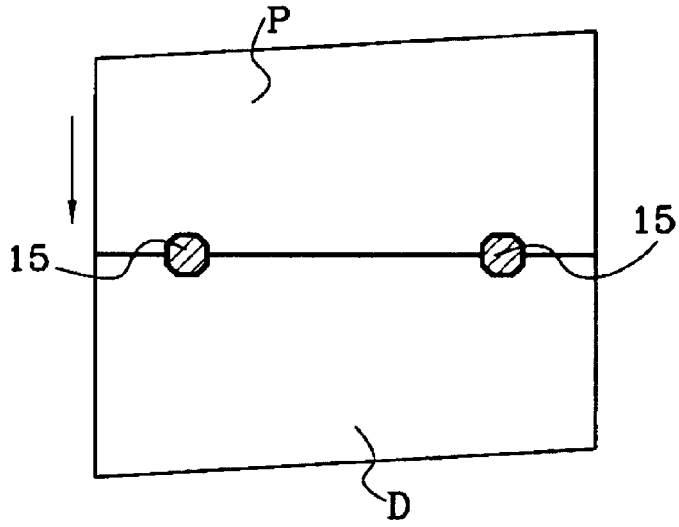

On one hand, there is an alternative trimming process, that is, forging process (S1-4B) as depicted in FIG. 4*h*. It is possible to trim out the rough cut edges of prototype latching loop (15) placing on a set of die (D) and punch (P) having semi-octagonal grooves. The punch (P) having a semi-octagonal groove is pressed down the rough cut edges of latching loop (15) for forming an octagonal shape. According to the present invention, it is possible to use various die and punch sets for trimming the rough cut edges of latching loop (15) to form a circular or round shape, hexagonal shape or octagonal shape of sections.

Next step is restriking process (S1-4C) for obtaining a final shape of latching loop (15) having allowable dimensions within a tolerance.

Figure 4I:
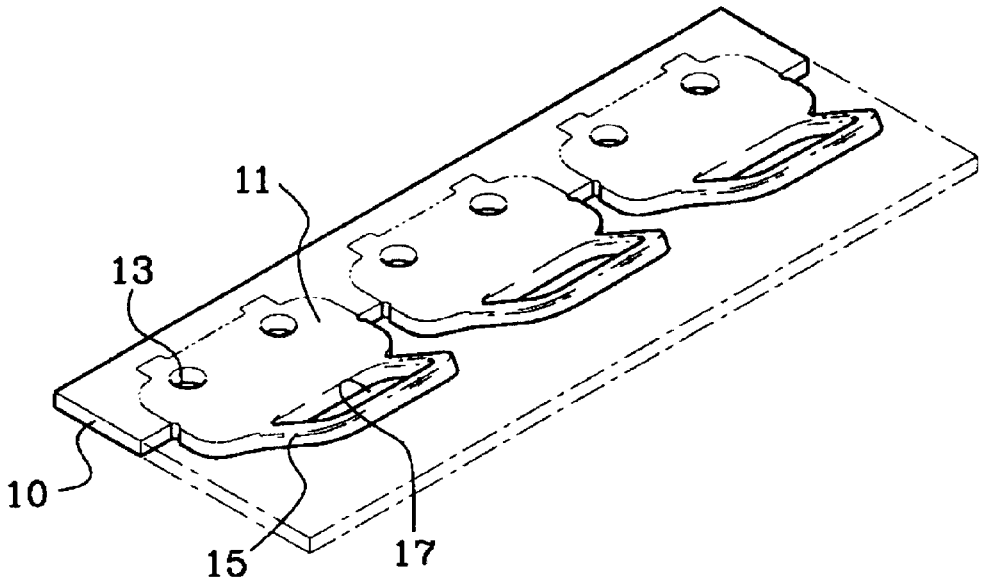
FIGS. 4*i* to 4*j* show a bending process (S1-5) for bending the latching loop upward in a predetermined angle against the bracket.
Figure 4J:
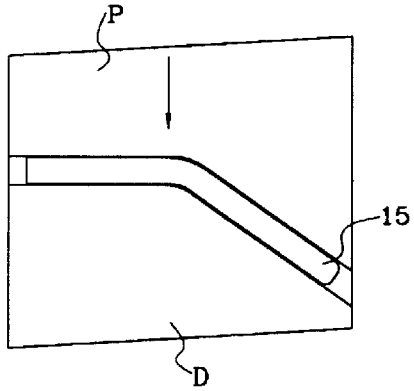

As depicted in FIGS. 4*i* and 4*j*, a bending process (S1-5) is performed for bending the final latching loop (15) upwardly in a predetermined angle against the bracket (11) by using a punch or press bending means.

Figure 4K:
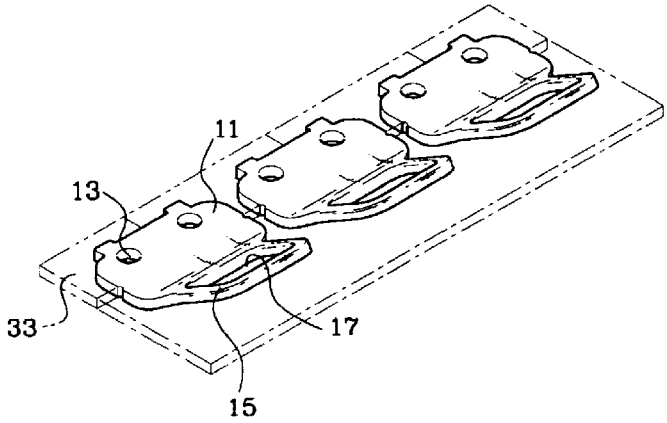
FIG. 4*k* illustrates a performance of third notching process (S1-6) to separate the individual bracket by punching out a third part.
Figure 4L:
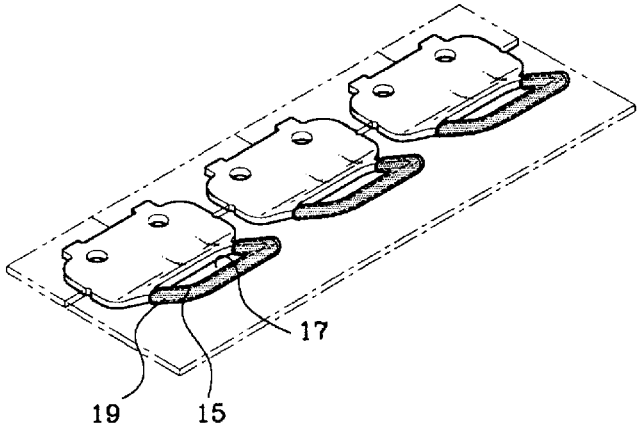
FIG. 4*l* shows a performance of finishing process (S2) for coating noise damping materials by ejecting synthetic resins.

Next step as depicted in FIG. 4*k*, third notching process (S1-6) is performed for punching out a third part (33) or supporting area of multi-brackets of sheet metal to separate individual bracket (11).

At a step of painting process (S1-7), the separated individual bracket being underwent the entire process of S1-1 through S1-6 performs a surface treatment for coating rustproof materials with predetermined color. In addition, it is preferred to apply a heat treatment after paint coating process.

Finally, a finishing process (S2) as depicted in FIG. 41 is performed for coating noise damping materials on the entire or partial area of latching loop (15) by ejecting the synthetic resin, synthetic rubber or more reliably thermoplastic resin materials. Therefore, a formation of novel striker for locking a glove box of the present invention is completed.

Figure 5:
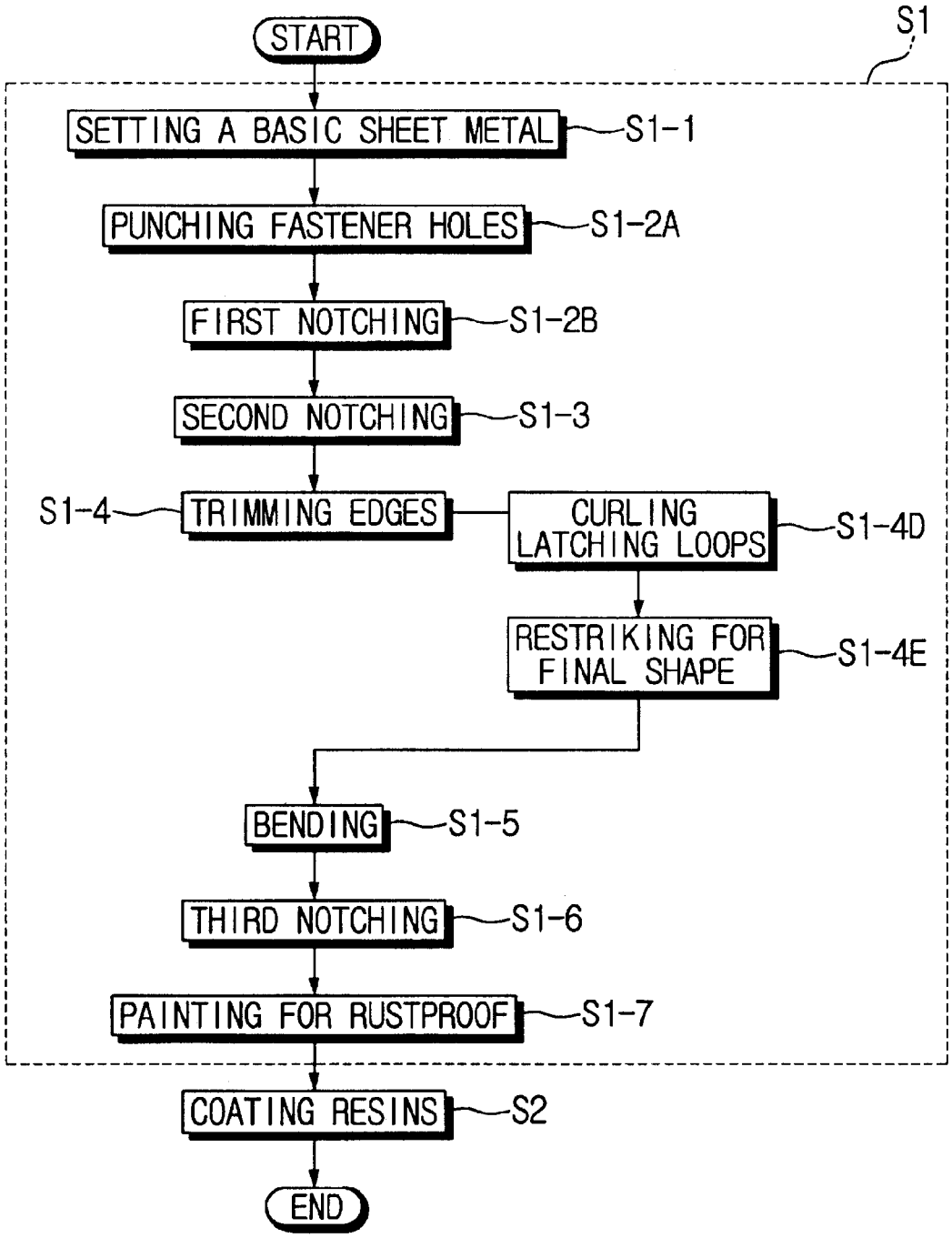
FIG. 5 is a flow chart for forming an alternative striker of glove box according to another embodiment of the present invention.

As shown in FIG. 5, a flow chart for forming an alternative striker of glove box according to another embodiment of the present invention is disclosed. Most process is similar to that of previous embodiment except a curling process (S1-4D) for curling up the prototype latching loop (25) to form an annular cross section with a hollow center and restriking process (S1-4E) for obtaining a final latching loop having accurate dimensions. Another difference is a rough cut width of prototype latching loop (25) in the first notching process (S1-2) and second notching process (S1-3). The rough cut width of prototype latching loop (25) is as twice wider as that of previous embodiment (15).

The descriptions of duplicated steps, S1-1 to S1-4 and S1-5 to S-2 are omitted hereinafter, since the process is same as that of previously described steps. Only the difference is described in detail.

Figure 6A:
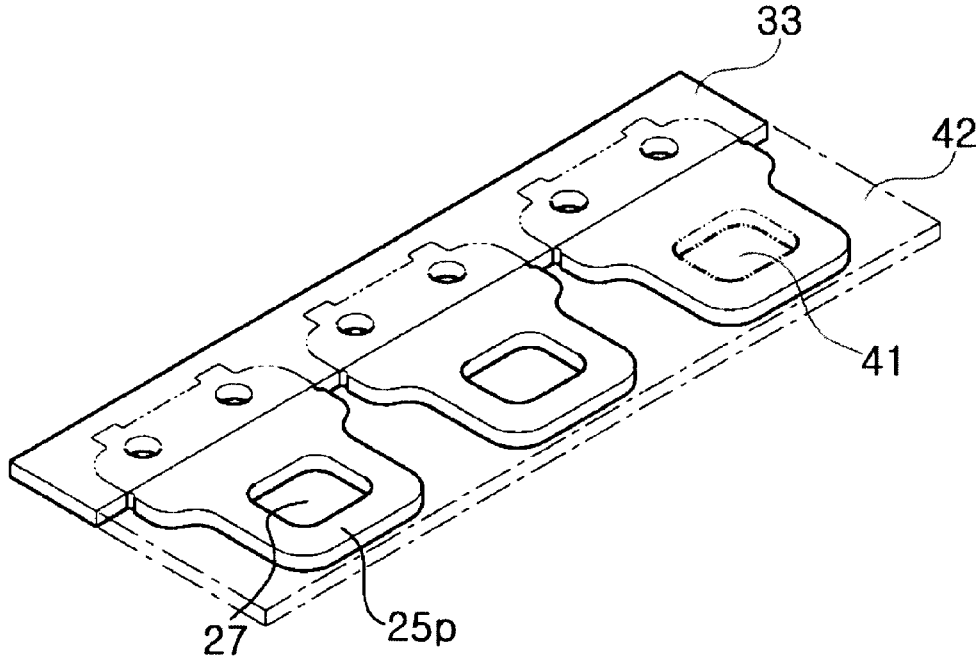
FIG. 6*a* shows a performance of punching process (S1-2*a*) for punching out fastener holes (S1-2*a*), first notching process (S1-2*b*) and second notching process (S1-3) for punching out first and second parts.

As shown in FIG. 6*a*, first notching process (S1-2*b*) is performed for punching out a first part (41) or an area of inner loop, which is smaller area than the actual latching space (27) and that of previous embodiment. The second notching process (S1-3) is performed for punching out a second part (42) or an area of outer loop to form a wider width of prototype latching loop (25) than that of previous embodiment. Therefore, a width of rough cut or prototype latching loop (25) is provided as twice wider as that of previous embodiment.

Figure 6B:
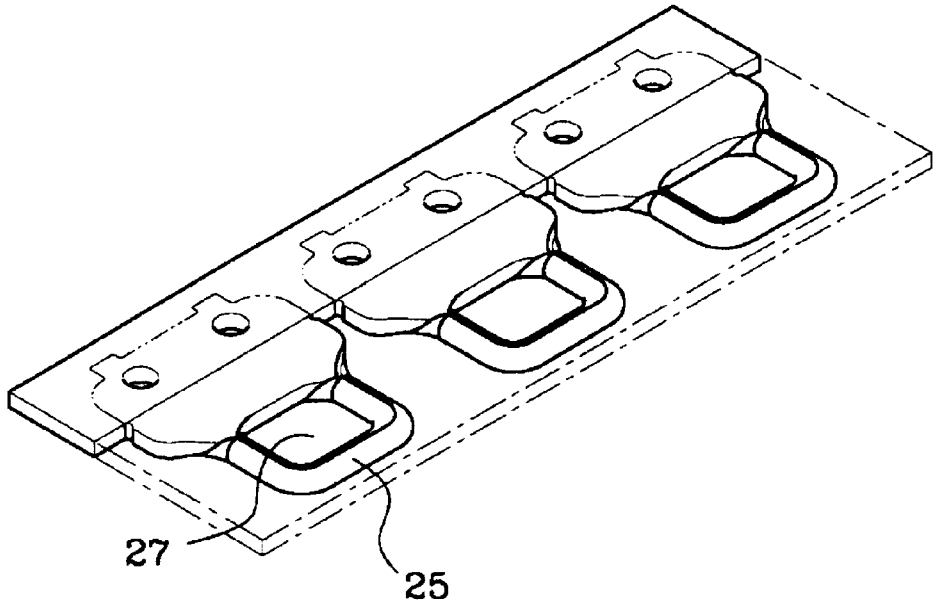
FIGS. 6*b* to 6*e* show a series of curling process (S1-4D) for rounding up the prototype latching loop to form an annular section.

As depicted in FIG. 6*b*, a curling process (S1-4D) is subsequently performed for curling and rounding up the prototype latching loop (25) to form an annular section with a hollow center.

Figure 6C:
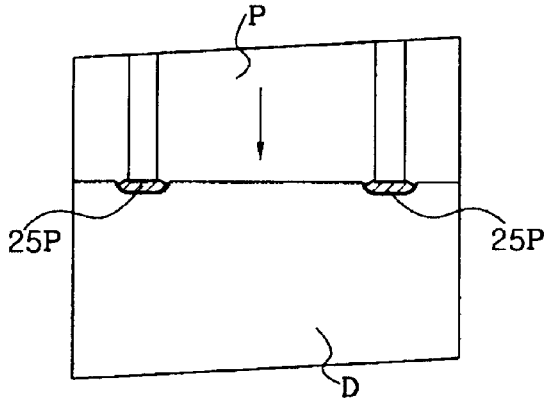
Figure 6D:
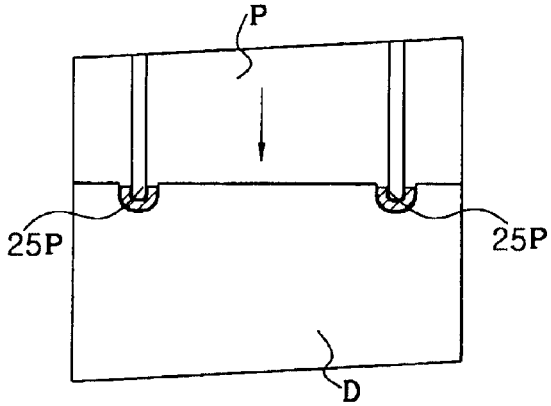
Figure 6E:
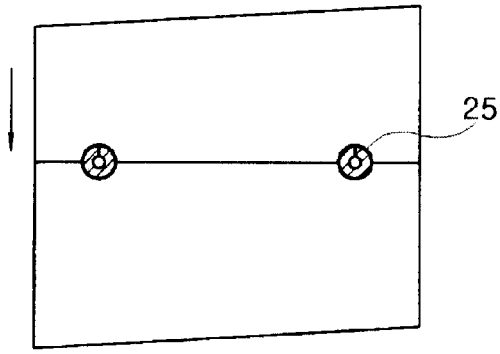
Figure 7A:
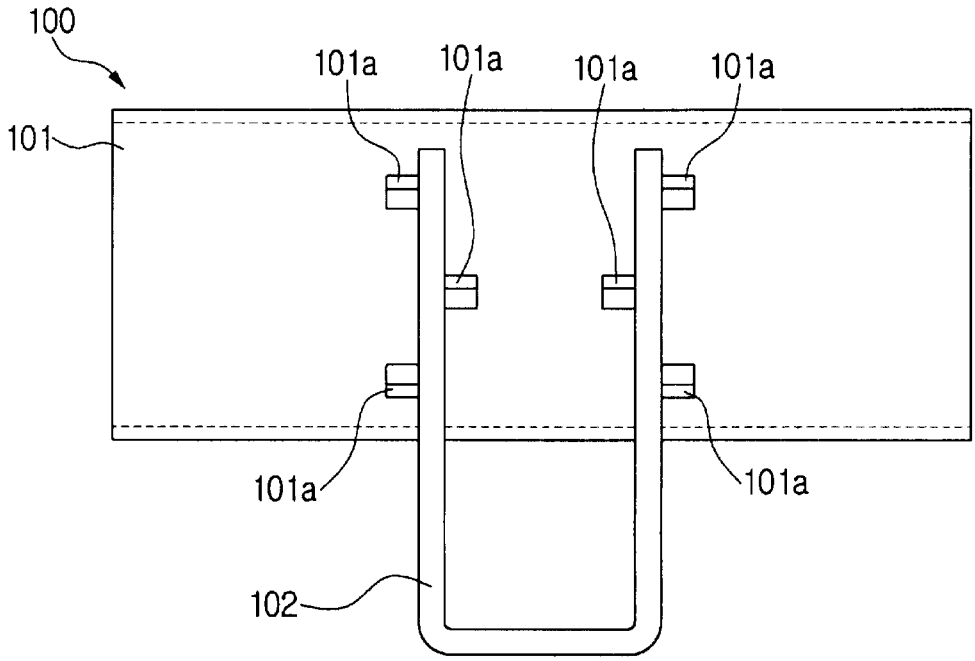
FIG. 7a(Prior Art)
FIG. 7*a* is a plane view of conventional striker showing assembly of a bracket and a latching loop.
Figure 7B:
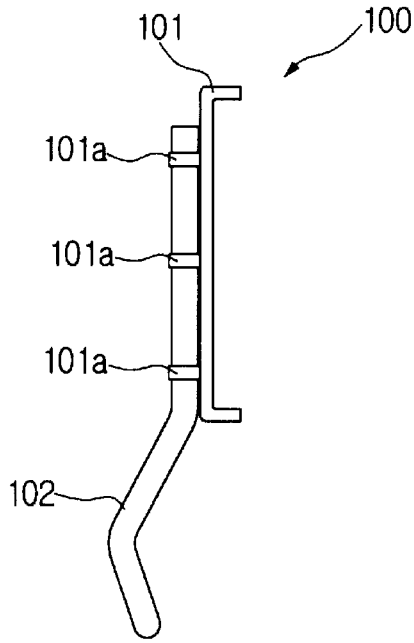
FIG. 7b(Prior Art)
FIG. 7*b* is a side view of conventional striker showing assembly of a bracket and a latching loop.

As depicted in FIG. 6*c*, a punch (P) presses the prototype latching loop (25) for expending widely. Next steps as shown in FIGS. 6*d* and 6*e*, second and third rounding process are performed sequentially for curling and rounding up the expended prototype latching loop (25) to form an annular section.

Finally, restriking process (S1-4E) is performed for obtaining the final latching loop to have accurate dimensions within a tolerance.

Hereinafter, rest of process will be omitted, since the process is same as that of previously described steps.

When a novel striker for locking a glove box of the present invention is applied to a practice, the manufacturing process of striker would be simplified. Therefore, the manufacturing facilities and manpower required for production could be reduced. Consequently, the productivity would be improved, and the production cost would be remarkably reduced.

As discussed above, the advantages of applying this striker for the glove box according to the present invention are; because the structure of striker is formed integrally to the latching loop and bracket, it is possibly simplified the manufacturing process, reduced the manufacturing cost and noise generated by frictions during a vehicle operation and increased the competitiveness and reliability.

While the present invention has been described in detail with its preferred embodiments, it will be understood that it further modifications are possible. The present application is therefore intended to cover any variations, uses or adaptations of the invention following the general principles thereof, and includes such departures from the present disclosure as come within known or customary practice in the art to which this invention pertains within the limits of the appended claims.

What is claimed is:

1. A process for forming a striker of glove box, which is located in front of a passenger seat to store miscellaneous, comprises steps of:

setting process (S1-1) for setting a prepared basic sheet metal (10) having a predetermined thickness, width and length on a processing machinery, punching process (S1-2*a*) for punching out a series fastener holes (13) with a certain preset diameter, first notching process (S1-2*b*) for removing a first part of inner loop (31) to form a latching space (17), second notching process (S1-3) for punching out a second part of outer loop (32) to form a prototype latching loop (15), trimming process (S1-4) for trimming rough cut edges of prototype latching loop (15), bending process (S1-5) for bonding said latching loop (15) upward in a predetermined angle against bracket (11), third notching process (S1-6) for punching out a third part (33) or multi-brackets supporting area to separate individual bracket (11), painting process (S1-7) for coating rustproof materials on the individual bracket (11), and finishing process (S2) for coating noise damping materials on entire or partial area of latching loop (15) by ejecting means.

2. A process according to claim 1, wherein said trimming process (S1-4) comprises a rounding process (S1-4A) for rounding rough cut edges of latching loop (15) to form a circular cross section.

3. A process according to claim 1, wherein said trimming process (S1-4) comprises a forging process (S1-4B) for forging rough cut edges of latching loop (15) to form an octagonal cross section.

4. A process according to claim 2, said trimming process (S1-4) further comprises a restriking process (S1-4C) for trimming said latching loop (15) to have allowable dimensions within a tolerance subsequent to rounding process (S1-4A).

5. A process according to claim 3, said trimming process (S1-4) further comprises a restriking process (S1-4C) for trimming said latching loop (15) to have allowable dimensions within a tolerance subsequent to forging process (S1-4B).

6. A process according to claim 1, said trimming process (S1-4) further comprises a curling process (S1-4D) for forming an annular section of latching loop (25) by curling and rounding up a prototype latching loop (25*p*).

7. A process according to claim 6, said trimming process (S1-4) further comprises a restriking process (S1-4E) for obtaining allowable dimensions of annular sectioned latching loop (25) within a tolerance subsequent to said curling process (S1-4D).

* * * * *